US009791808B2

(12) United States Patent
Aoto et al.

(10) Patent No.: US 9,791,808 B2
(45) Date of Patent: Oct. 17, 2017

(54) INTERMEDIATE TRANSFER BELT, METHOD FOR PRODUCING THE SAME, AND IMAGE FORMING APPARATUS

(75) Inventors: Jun Aoto, Kanagawa (JP); Hidetaka Kubo, Kanagawa (JP); Kenichi Mashiko, Kanagawa (JP); Sayaka Katoh, Kanagawa (JP); Shinichi Nitta, Miyagi (JP); Shigeo Oonuma, Miyagi (JP)

(73) Assignee: RICOH COMPANY, LTD., Tokyo (JP)

( * ) Notice: Subject to any disclaimer, the term of this patent is extended or adjusted under 35 U.S.C. 154(b) by 929 days.

(21) Appl. No.: 13/007,813

(22) Filed: Jan. 17, 2011

(65) Prior Publication Data

US 2011/0177238 A1 Jul. 21, 2011

(30) Foreign Application Priority Data

Jan. 20, 2010 (JP) ..... 2010-009871

(51) Int. Cl.
*G03G 15/14* (2006.01)
*G03G 15/16* (2006.01)

(52) U.S. Cl.
CPC ..... *G03G 15/162* (2013.01); *G03G 15/14* (2013.01); *G03G 15/16* (2013.01)

(58) Field of Classification Search
CPC ..... G03G 15/162; G03G 15/14; G03G 15/16
USPC ..... 399/159, 162, 303; 428/327, 331
See application file for complete search history.

(56) References Cited

U.S. PATENT DOCUMENTS

| | | | | |
|---|---|---|---|---|
| 5,666,193 | A | 9/1997 | Rimai et al. | |
| 6,078,773 | A * | 6/2000 | Shimojo | G03G 15/162 399/302 |
| 6,589,700 | B2 | 7/2003 | Tsutsumi et al. | |
| 7,611,815 | B2 * | 11/2009 | Sugiura et al. | 430/108.7 |
| 2004/0146315 | A1 * | 7/2004 | Ueda et al. | 399/159 |
| 2008/0107457 | A1 * | 5/2008 | Katoh | G03G 15/162 399/302 |
| 2009/0208258 | A1 * | 8/2009 | Aoto | G03G 15/162 399/308 |

FOREIGN PATENT DOCUMENTS

| | | |
|---|---|---|
| JP | 5-330263 | 12/1993 |
| JP | 9-230717 | 9/1997 |
| JP | 9-281813 | 10/1997 |
| JP | 10-307485 | 11/1998 |
| JP | 2002-162767 | 6/2002 |
| JP | 2007-328165 | 12/2007 |
| JP | 2008-191225 | 8/2008 |

(Continued)

OTHER PUBLICATIONS

D.S. Rimai, L.P. Demejo, R.C. Bowen, "Mechanics of particle adhesion," Published Jan. 1, 1994, Journal of Adhesion Science and Technology, vol. 8, Issue 11, pp. 1333-1355.*

(Continued)

*Primary Examiner* — Nicholas Kokkinos
(74) *Attorney, Agent, or Firm* — Cooper & Dunham LLP

(57) ABSTRACT

The surface layer of an intermediate transfer belt has a concavo-convex pattern formed thereon by spherical resin particles which are independently embedded in the layer so that the embedment rate in the thickness direction of the layer is higher than 50% but lower than 100%.

10 Claims, 6 Drawing Sheets

(56) References Cited

FOREIGN PATENT DOCUMENTS

| | | |
|---|---|---|
| JP | 2009-47904 | 3/2009 |
| JP | 2009-75154 | 4/2009 |
| JP | 4430892 | 12/2009 |

OTHER PUBLICATIONS

"Definitions of Resins," Obtained Sep. 10, 2013, SPI: The Plastics Industry Trade Association, http://www.plasticsindustry.org/Press/content.cfm?ItemNumber=656&&navItemNumber=1322.*

Apr. 14, 2011 European search report in connection with counterpart European patent application No. 11 15 1447.

Japanese official action dated Apr. 4, 2014 in corresponding Japanese patent application No. 2010-009871.

* cited by examiner

Prior Art

Prior Art

INTERMEDIATE TRANSFER BELT, METHOD FOR PRODUCING THE SAME, AND IMAGE FORMING APPARATUS

BACKGROUND OF THE INVENTION

Field of the Invention

The present invention relates to an intermediate transfer belt (seamless belt) which is mounted in image forming apparatuses such as copiers, printers or the like, and is suitable for full-color image formation, a method for producing the intermediate transfer belt, and an electrophotographic apparatus using the intermediate transfer belt.

Description of the Related Art

Conventionally, in electrophotographic image forming apparatuses, seamless belts have been used as members for various applications. Particularly, in full-color electrophotographic apparatuses of recent years, an intermediate transfer belt system is used, in which development images of four colors: yellow, magenta, cyan, black, are superimposed on an intermediate transfer medium, and then the superimposed images are collectively transferred to a transfer medium, such as paper.

In such intermediate transfer belt system, with respect to a photoconductor four developing units are used, but use of such intermediate transfer belt system has a disadvantage that print speed is slow. For high speed printing, a four-series tandem system is used in which photoconductors for four colors are arranged in a tandem manner, and each color is continuously transferred on paper. However, in this system, it is difficult to achieve accurate registration upon superimposing respective images because of change of paper condition due to environment, causing out-of-color registration. Thus, recently, an intermediate transfer system has been predominately applied in the four-series tandem system.

For this reason, characteristics required for the intermediate transfer belt have been tough to achieve, such as high speed transfer, positional accuracy, etc., but it is necessary to satisfy those characteristics. Particularly, it is demanded to inhibit variation in positional accuracy caused by deformation such as elongation of a belt itself due to continuous use. The intermediate transfer belt is required to be heat resistant and flame retardant, because it occupies a large area of an apparatus and a high voltage is applied thereto for transferring an image. In order to satisfy these demands, as an intermediate transfer belt material, a polyimide resin, and a polyamideimide resin, which have high elasticity and high heat resistance, are used.

However, an intermediate transfer belt made of a polyimide resin has high strength and thus high surface hardness. Therefore, in transferring a toner image, a high pressure is applied to the toner layer. As a result, the toner is locally aggregated, resulting in that part of the image is not transferred in some cases to form a so-called spot-containing image. Also, such an intermediate transfer belt has poor followability to a photoconductor, paper, etc., which are brought into contact with the intermediate transfer belt at transfer positions. Such poor followability may cause insufficient contact portions (spaces) at the transfer positions, leading to uneven transfer.

In recent years, full-color electrophotographic image formation is often performed on various types of paper, such as commonly-used smooth paper, highly-smooth papers with slip properties (e.g., coated papers) and rough paper (e.g., recycled paper, embossed paper, Japanese paper and kraft paper). In the full-color electrophotographic image formation, followability to such papers that have various surface conditions is important. Poor followability causes unevenness in image density and color toner following irregularities of paper.

In order to solve this problem, various intermediate transfer belts have been proposed which contain a base layer and a relatively flexible layer laminated on the base layer.

However, when the relatively flexible layer is used as a surface layer, the pressure during transfer may be reduced. In addition, although the followability to irregularities of paper is improved, toner cannot be separated from the surface layer since the toner releasability of the surface is poor. As a result, the transfer efficiency is decreased while the followability is improved. Furthermore, such a surface layer is problematically degraded in wear resistance and abrasion resistance.

In order to solve this problem, methods have been proposed in which a protective layer is further provided. The protective layer made of a material having sufficiently high transferability cannot comply with the flexible layer and is unfavorably cracked or peeled off. In other proposals, provision of fine particles in the surface improves transferability.

Specifically, Japanese Patent Application Laid-Open (JP-A) No. 09-230717 proposes that beads having a diameter of 3 μm or smaller are coated.

However, in the technique disclosed in this patent literature, the particles tend to be exfoliated. Thus, this technique is not sufficient to meet the requirements for the recent electrophotographic apparatuses.

Also, JP-A Nos. 2002-162767 and 2004-354716 proposed that a layer is formed from a material having an affinity to hydrophobidized fine particles. In these patent literatures, particles having a very small particle diameter are preferably used.

However, the particle layer is thick and has ununiform areas formed due to aggregation of the particles, causing variation in transferability. This technique is not sufficient to meet the requirements for the formation of high-quality images by the recent electrophotographic apparatuses.

Moreover, JP-A Nos. 2007-328165 and 2009-75154 proposed that relatively large particles are partially embedded in the surface resin layer to realize satisfactory durability. However, even in these proposals, the particles are stacked in the thickness direction, and some of the particles are completely embedded in the resin layer, resulting in that the particles are ununiformly present in the layer. This technique is also not sufficient to meet the requirements for the formation of high-quality images by the recent electrophotographic apparatuses.

In any of the techniques disclosed in JP-A Nos. 09-230717, 2002-162767, 2004-354716, 2007-328165 and 2009-75154, silica particles are preferably used. The silica particles strongly aggregate together and thus, as described above, a uniform particle layer cannot be formed. Furthermore, such inorganic particles as silica tend to scratch and abrade the surface of an organic photoconductor, which is suitably used as an image bearing member responsible for image formation, when comes into contact with the organic photoconductor at the transfer position, causing a failure of degrading durability.

BRIEF SUMMARY OF THE INVENTION

The present invention aims to provide an intermediate transfer belt which has flexibility and excellent toner releasability, which can realize a high transfer rate regardless of the type of the recording medium, which can be consistently used for a long period of time, which does not damage organic photoconductors, and which can form highly durable, high-quality images; a method for producing the intermediate transfer belt; and an image forming apparatus containing the intermediate transfer belt.

The present inventor conducted extensive studies to solve the above existing problems, and has found that the surface of the intermediate transfer belt is a resin layer having a uniform concavo-convex pattern formed by spherical resin particles independently arranged along the layer surface so as to form a particle monolayer, which can solve the above existing problems.

The present invention is based on the above finding obtained by the present invention. Means for solving the above existing problems are as follows.

<1> An intermediate transfer belt including:

a resin layer, which is a surface layer of the intermediate transfer belt, wherein the resin layer has a concavo-convex pattern formed by spherical resin particles which are independently embedded in the resin layer so that the embedment rate of the spherical resin particles in the thickness direction of the resin layer is higher than 50% but lower than 100%.

<2> The intermediate transfer belt according to <1> wherein the spherical resin particles are monodispersed particles having an average particle diameter of 0.5 μm to 5.0 μm.

<3> The intermediate transfer belt according to one of <1> and <2>, wherein the spherical resin particles are contained in the resin layer at a uniform state in the thickness direction of the resin layer.

<4> The intermediate transfer belt according to any one of <1> to <3>, wherein the resin of the resin layer contains a thermosetting elastomer or rubber material.

<5> The intermediate transfer belt according to any one of <1> to <4>, wherein the spherical resin particles are fine silicone resin particles.

<6> An image forming apparatus including:

the intermediate transfer belt according to any one of <1> to <5>.

<7> A method for producing an intermediate transfer belt, including:

uniformly applying spherical resin particles through a dry process to a layer of a resin coating liquid on the intermediate transfer belt, and leveling the layer with a leveling unit so that the spherical resin particles are arranged and embedded in the layer, to form a surface of the intermediate transfer belt, wherein the spherical resin particles are independently embedded in the layer so that the embedment rate of the spherical resin particles in the thickness direction of the layer is higher than 50% but lower than 100%, and wherein the surface of the intermediate transfer belt has a concavo-convex pattern formed by the spherical resin particles.

<8> The method according to <7>, wherein the spherical resin particles are monodispersed particles having an average particle diameter of 0.5 μm to 5.0 μm.

<9> The method according to one of <7> and <8>, wherein the spherical resin particles are contained in the layer at a uniform state in the thickness direction of the resin layer.

<10> The intermediate transfer belt according to any one of <7> to <9>, wherein the resin of the resin layer contains a thermosetting elastomer or rubber material.

<11> The intermediate transfer belt according to any one of <7> to <10>, wherein the spherical resin particles are fine silicone resin particles.

The present invention can provide an intermediate transfer belt which can realize a high transferability regardless of the type (surface conditions) of the recording medium for a long period of time, which does not damage organic photoconductors, and which can form highly durable, high-quality images for a long period of time; a method for producing the intermediate transfer belt; and an image forming apparatus containing the intermediate transfer belt.

DETAILED DESCRIPTION OF THE INVENTION

An intermediate transfer belt (seamless belt) of the present invention has, as a surface layer, a resin layer having a uniform concavo-convex pattern formed by spherical resin particles independently arranged along the layer surface so as to form a particle monolayer.

Here, the description "spherical resin particles which are independently embedded in the resin layer" means that spherical resin particles are not overlapped with each other.

Also, the description "spherical resin particles are contained at a uniform state in the thickness direction" means that spherical resin particles are contained so that the spherical resin particles are not stacked on top of each other in the thickness direction.

Next, description will be given to an intermediate transfer belt of the present invention.

The intermediate transfer belt of the present invention is suitably mounted to an image forming apparatus employing an intermediate transfer belt, in which a plurality of color toner-developed images are sequentially formed on image bearing members (e.g., photoconductor drums), and then primarily transferred onto and sequentially superposed on an intermediate transfer belt, and the resultant primarily-transferred image is secondarily transferred onto a recording medium at one time.

Figure 1:
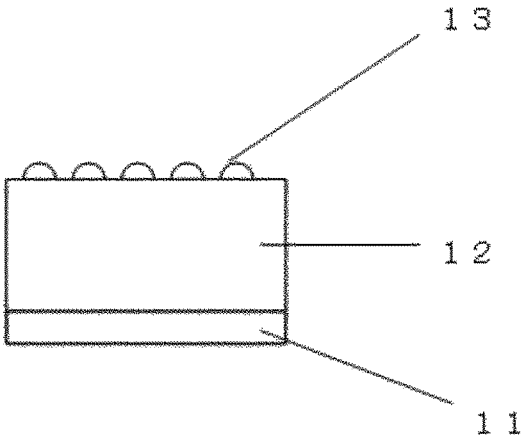
FIG. 1 is a schematic view of one exemplary layer structure of an intermediate transfer belt of the present invention.

FIG. 1 illustrates a non-limitative, suitable layer structure of an intermediate transfer belt of the present invention.

This layer structure is composed of a relatively flexible, rigid base layer 11, a flexible resin layer 12 laminated on the base layer, and spherical resin particles 13, which are uniformly provided in the uppermost surface of the resin layer 12.

In the uniform state of the resin particles 13 in the present invention, the following portions are not virtually observed; i.e., portions where the resin particles 13 are stacked on top of each other in the thickness direction, and portions where the resin particles 13 are completely embedded in the resin layer 12.

<Base Layer>

Firstly, a base layer 11 will be described.

The material for the base layer, a resin containing a filler (or an additive) for adjusting electrical resistance, a so-called electrical resistance control agent is exemplified.

Examples of the resin include fluorine resins such as PVDF, ETFE, polyimide resins (also referred to as "polyimide") and polyamideimide resins (also referred to as "polyamideimide"), in terms of flame retardancy. Of these, polyimide and polyamideimide are particularly preferable, in terms of mechanical strength (high elasticity), and heat resistance.

Examples of the electrical resistance control agents include metal oxides, and carbon blacks; ion conductive agents; and conductive polymers.

Examples of the metal oxides include zinc oxide, tin oxide, titanium oxide, zirconium oxide, aluminum oxide and silicon oxide. Further examples include products obtained by subjecting the above metal oxides to a surface treatment for improving dispersibility thereof.

Examples of the carbon blacks include ketjen black, furnace black, acetylene black, thermal black, and gas black.

Examples of the ion-conductive agents include tetraalkyl ammonium salts, trialkylbenzyl ammonium salts, alkylsulfonic acid salts, alkylbenzenesulfonic acid salts, alkylsulfates, glycerin fatty acid esters, sorbitan fatty acid esters, polyoxyethylenealkylamine, esters of polyoxyethylenealiphatic alcohols, alkylbetaine, lithium perchlorate, etc. These may be used alone or in combination.

The electrical resistance control agents are not limited to the above exemplified compounds.

In a method for producing an intermediate transfer belt of the present invention a coating liquid containing at least a resin component may contain additives such as a dispersing agent, reinforcing agent, lubricant, heat conduction agent, and antioxidant, if necessary.

The amount of the electrical resistance control agent contained in the seamless belt, which is suitably used as the intermediate transfer belt, is preferably controlled so that the surface resistance is adjusted to $1\times10^{8}$ Ω/square to $1\times10^{13}$ Ω/square and the volume resistance is adjusted to $1\times10^{6}$ Ω·cm to $1\times10^{12}$ Ω·cm. The electrical resistance control agent must be added in such an amount that the formed film does not become brittle and easily cracked.

That is, in producing an intermediate transfer belt, preferably, the above resin components (e.g., a polyimide or polyamideimide resin precursor) and the electrical resistance control agent are mixed together in an appropriate proportion to thereby prepare a coating liquid, which is then used to produce a seamless belt having well-balanced electrical characteristics (surface resistance and volume resistance) and mechanical strength.

When carbon black is used as the electrical resistance control agent, the amount of the carbon black is 10% by mass to 25% by mass, preferably 15% by mass to 20% by mass, relative to the total solid content of the coating liquid. When a metal oxide is used as the electrical resistance control agent, the amount of the metal oxide is 1% by mass to 50% by mass, preferably 10% by mass to 30% by mass, relative to the total solid content of the coating liquid. When the amounts of the carbon black and the metal oxide are smaller than the above corresponding lower limits, the effects of the carbon black and the metal oxide are not sufficiently obtained. When the amounts of the carbon black and the metal oxide are greater than the above corresponding upper limits, the intermediate transfer belt (seamless belt) is degraded in mechanical strength, which is not practically preferred.

A polyimide resin (hereinafter, also referred to as "polyimide") or a polyamideimide resin (hereinafter, also referred to as "polyamideimide"), which are suitably used for materials of the intermediate transfer belt, will be specifically described.

<Polyimide>

The polyimide is not particularly limited and can be appropriately selected depending on the intended purpose. For example, aromatic polyimide is preferable. The aromatic polyimide is obtained from polyamic acid (polyimide precursor), which is an intermediate product obtained by reacting a generally known aromatic polycarboxylic anhydride (or derivatives thereof) with aromatic diamine.

Because of stiff main chain, the polyimide, particularly, aromatic polyimide is insoluble in a solvent and is not melted. Therefore, at first, aromatic polycarboxylic anhydride is reacted with aromatic diamine so as to synthesize a polyimide precursor (i.e., a polyamic acid or polyamide acid) which is soluble in an organic solvent. The thus prepared polyamic acid is molded by various methods, followed by dehydration/cyclization treatment (i.e., imidization) upon application of heat thereto or using a chemical method, so as to form polyimide. The outline of the reaction is represented by Reaction Formula (1), which is an example of obtaining an aromatic polyimide.

Reaction Formula (1)

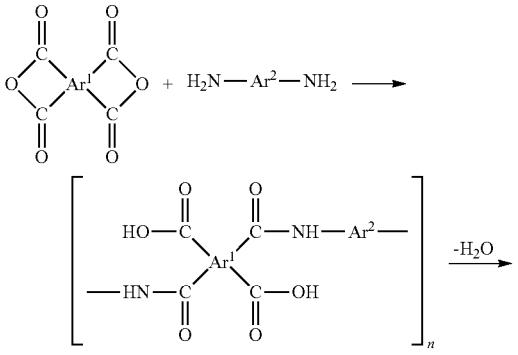

polyimide precursor

-continued

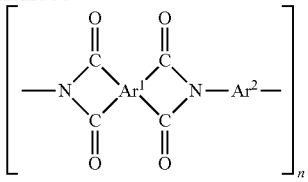

In Reaction Formula (1), $Ar^1$ denotes a tetravalent aromatic residue containing at least one six-membered carbon ring; and $Ar^2$ denotes a divalent aromatic residue containing at least one six-membered carbon ring.

Specific examples of tetravalent aromatic carboxylic anhydrides containing at least one six-membered carbon ring (aromatic polycarboxylic anhydrides) include pyromellitic dianhydride, 3,3',4,4'-benzophenonetetracarboxylic dianhydride, 2,2',3,3'-benzophenonetetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl) ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 1,2,3,4-benzenetetracarboxylic acid dianhydride, 3,4,9,10-perylenetetracarboxylic dianhydride, 2,3,6,7-anthracenetetracarboxylic dianhydride, and 1,2,7,8-phenanthrenetetracarboxylic dianhydride. These may be used alone or in combination.

Examples of anhydrides other than the aromatic polycarboxylic anhydrides represented by Reaction Formula (1) include aliphatic polycarboxylic anhydrides, such as ethylenetetracarboxylic dianhydride, and cyclopentanetetracarboxylic dianhydride. These may be used alone or in combination with the aromatic polycarboxylic anhydrides.

In Reaction Formula (1), the aromatic polycarboxylic anhydride is exemplified, but the derivatives thereof (for example, ester derivatives) may be used.

Next, examples of divalent aromatic diamines containing at least one six-membered carbon ring (aromatic diamines), which is reacted with the aromatic polycarboxylic anhydrides, include m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl)sulfide, bis(4-aminophenyl)sulfide, bis(3-aminophenyl)sulfoxide, (3-aminophenyl)(4-aminophenyl)sulfoxide, bis(3-aminophenyl)sulfone, (3-aminophenyl)(4-aminophenyl)sulfone, bis(4-aminophenyl)sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy)phenyl]methane, 1,1-bis[4-(3-aminophenoxy)phenyl]ethane, 1,1-bis[4-(4-aminophenoxy)phenyl]ethane, 1,2-bis[4-(3-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis(4-aminophenoxy)biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenyl sulfone, bis[4-{4-(4-aminophenoxy)phenoxy}phenyl]sulfone, 1,4-bis[4-(4-aminophenoxy)phenoxy]-α,α-dimethylbenzyl]benzene, and 1,3-bis[4-(4-aminophenoxy)-α,α-dimethylbenzyl]benzene. These may be used alone or in combination. Of these, 4,4'-diaminodiphenyl ether is particularly preferably used as at least one of the components for use in order to effectively exhibit the physical properties of the intermediate transfer belt of the present invention.

Meanwhile, aliphatic diamines other than the aromatic diamines represented by Reactive Formula (1) can be used, and may be used in combination with the aromatic diamines.

The aromatic polyimide is obtained in such a manner that a component of the aromatic polycarboxylic anhydride and a component of aromatic diamine are used approximately in an equimolar ratio, and subjected to polymerization reaction in an organic polar solvent so as to obtain a polyimide precursor (polyamic acid), and the polyamic acid is dehydrated, so as to cause cyclization and imidization. A method for producing a polyamic acid will be specifically described herein below.

Examples of the organic polar solvent, which is used in the polymerization reaction for obtaining polyamic acid, include sulfoxide solvents such as dimethylsulfoxide and diethylsulfoxide, formamide solvents such as N,N-dimethylformamide and N,N-diethylformamide, acetamide solvents such as N,N-dimethylacetamide and N,N-diethylacetamide, pyrrolidone solvents such as N-methyl-2-pyrrolidone and N-vinyl-2-pyrrolidone; phenol solvents such as phenol, o-, m- or p-cresol, xylenol, halogenated phenol, catechol; ether solvents such as tetrahydrofuran, dioxane, dioxolan; alcohol solvents such as methanol, ethanol, butanol; cellosolve solvents such as butyl cellosolve; and hexamethylphosphoramide, γ-butyrolactone. These may be used alone or in combination.

The solvent is not particularly limited and can be appropriately selected depending on the intended purpose, as long as the solvent can solve the polyamic acid. For example, N,N-dimethylacetamide, and N-methyl-2-pyrrolidone is particularly preferably used.

One example of a method for preparing a polyimide precursor is as follows. At first, in an inert gas (such as argon gas and nitrogen gas) environment, one or more diamines are dissolved in an organic solvent, or may be dispersed in an organic solvent to form a slurry. When one or more aromatic polycarboxylic anhydrides or derivatives thereof are added in the resultant solution, in a form of solid, solution (in which the aromatic polycarboxylic anhydrides or derivatives thereof are dissolved in the organic solvent) or a slurry, a ring opening polymerization reaction accompanied with generation of heat is induced. In this case, the viscosity of the mixture rapidly increases, and a solution of polyamic acid having a high molecular mass is produced. In this case, the reaction temperature is preferably −20° C. to 100° C., and more preferably 60° C. or lower. The reaction time is preferably approximately 30 minutes to approximately 12 hours.

The addition order as described-above is one example, and is not limited thereto. Alternatively, firstly, aromatic polycarboxylic anhydride (aromatic tetracarboxylic dianhydrides) or derivative thereof is dissolved or dispersed in an organic solvent, and then the aromatic diamine (also referred to as "diamines") may be added in the solution. The diamine may be added in a form of solid, solution (in which diamines are dissolved in the organic solvent) or slurry. That is, the addition order of an aromatic tetracarboxylic dianhydride component and a diamine component is not limited. In addition, the aromatic tetracarboxylic dianhydride and the aromatic diamine may be added at the same time to a polar organic solvent, so as to cause reaction.

As described above, the aromatic polycarboxylic anhydride or derivative thereof and the aromatic diamine component in an approximately equimolar ratio are polymerized in an organic polar solvent, so that a solution of a polyimide precursor in which the polyamic acid is uniformly dissolved in the polar organic solvent can be prepared.

As a polyimide precursor solution (i.e., a polyamic acid solution, "coating liquid containing polyimide resin precursor") used in the present invention, the polyimide precursor solution synthesized as described-above can be used. Alternatively, as a convenient way, commercially available polyamic acid composition dissolved in an organic solvent, or polyimide varnishes may be used.

Specific examples of the commercially available polyimide varnishes include TORENEES (manufactured by Toray Industries INC.), U-VARNISH (manufactured by Ube Industries, Ltd.), RIKA COAT (manufactured by New Japan Chemical Co., Ltd.), OPTOMER (manufactured by JSR Corporation), SE812 (manufactured by Nissan Chemical Industries, Ltd.), and CRC8000 (manufactured by Sumitomo Bakelite Co., Ltd.).

The thus synthesized or commercially available polyamic acid solution may be optionally mixed and dispersed with a filler (for example, additives such as an electrical resistance control agent, dispersing agent, reinforcing agent, lubricant, heat conduction agent, antioxidant) to prepare a coating liquid. The coating liquid is applied to a support (or a mold) as described below, and the coated liquid is then subjected to a treatment such as heating. Thus, the polyamic acid (i.e., a polyimide precursor) is transformed into polyimide (i.e., imidization).

The above-mentioned imidization reaction (i.e., conversion of a polyamic acid to a polyamide) is performed by (1) a heating method as described above or (2) a chemical method.

In (1) the heating method, the polyamic acid is heated at a temperature of 200° C. to 350° C. to be transformed into polyimide. The heating method is a simple and useful method of obtaining polyimide (a polyimide resin).

In (2) the chemical method, the polyamic acid is reacted with a dehydration ring forming agent such as mixtures of a carboxylic anhydride and tertiary amine, and then the reaction product is heated to complete imidization. Thus, (2) the chemical method is complicated compared to (1) the heating method and therefore the manufacturing costs are relatively high. Accordingly, (1) the heating method is popularly used.

In general, it is preferred that polyamic acid or the reaction product thereof be completely imidized by heating at a temperature equal to or higher than the glass transition temperature of a resultant polyimide, so as to exhibit the polyimide intrinsic properties.

The imidization ratio (i.e., the degree of a polyamic acid transformed into a polyimide) can be determined by any known methods which are used for measuring the imidization ratio.

Examples thereof include a nuclear magnetic resonance (NMR) method in which the imidization ratio is determined on the basis of an integral ratio of $^1$H of the amide group observed at 9 ppm to 11 ppm to $^1$H of the aromatic group observed at 6 ppm to 9 ppm; a Fourier transfer infrared spectrophotometric method (i.e., FT-IR method); a method of determining water caused by an imide ring closure; and a method in which the amount of residual carboxylic acid is determined by a neutralization titration method. Of these methods, the Fourier transfer infrared spectrophotometric method (FT-IR method) is particularly commonly used.

When the FT-IR method is used, the imidization ratio is determined by the following equation (a).

$$\text{Imidization ratio}(\%)=[(A)/(B)]\times 100 \quad \text{(a)}$$

In the equation above, (A) represents the number of moles of the imide groups determined in the heating step (i.e., imidization step); and (B) represents the number of moles of the imide groups, when the polyamic acid is completely imidized (theoretically calculated).

The number of moles of the imide groups in this definition can be determined by the absorbance ratio of the characteristic absorption of the imide group, measured by the FT-IR method. For example, as a typical characteristic absorption, the imidization ratio can be evaluated using the following absorbance ratio:

(1) A ratio of the absorbance of a peak at 725 cm$^{-1}$, which is specific to the imide, and caused by the bending vibration of the C═O group of the imide ring, to the absorbance of a peak at 1,015 cm$^{-1}$ which is specific to the benzene ring;

(2) A ratio of the absorbance of a peak at 1,380 cm$^{-1}$, which is specific to the imide, and caused by the bending vibration of the C—N group of the imide ring, to the absorbance of a peak at 1,500 cm$^{-1}$ which is specific to the benzene ring;

(3) A ratio of the absorbance of a peak at 1,720 cm$^{-1}$, which is specific to the imide, and caused by the bending vibration of the C═O group of the imide ring, to the absorbance of a peak at 1,500 cm$^{-1}$ which is specific to the benzene ring; and (4) A ratio of the absorbance of a peak at 1,720 cm$^{-1}$, which is specific to the imide, to the absorbance of a peak at 1,670 cm$^{-1}$, which is specific to the amide group (the interaction of the bending vibration of the N—H group and the stretching vibration of the C—N group of the amide group). Alternatively, when it is confirmed that the multiple absorption bands at 3,000 cm$^{-1}$ to 3,300 cm$^{-1}$, which are specific to the amide group, disappear, the reliability of completion of the imidization reaction is further enhanced.

<Polyamideimide>

Next, polyamideimide will be specifically described.

Polyamideimide has both an imide group which is rigid and an amide group which can impart flexibility to a resin in a molecular skeleton thereof. Polyamideimide having known structures can be used in the present invention. The polyamideimide is not particularly limited, and can be appropriately selected depending on the intended purpose. Aromatic polyamideimides are particularly preferably used.

The polyamideimide is synthesized by the following known methods, for example, (a) an acid chloride method, (b) an isocyanate method, or the like.

(a) The acid chloride method in which a polyamideimide is obtained from polyamide-amic acid (polyamideimide resin precursor), which is an intermediate product obtained by reacting a derivative of a trivalent carboxylic acid compound having an acid anhydride group and a carbonyl halide group (hereinafter also referred to as "a derivative halide of a trivalent carboxylic acid compound having an acid anhydride group") (e.g., typically, an acid chloride compound of the derivative) with diamine in a solvent (disclosed in, for example, Japanese patent application publication (JP-B) No. 42-15637).

(b) The isocyanate method in which a polyamideimide is produced by reacting a trivalent carboxylic acid compound having an acid anhydride group and a carboxylato group (hereinafter, also referred to a as "a derivative of a trivalent carboxylic acid having an acid anhydride group") with an isocyanate compound (particularly preferably an aromatic isocyanate compound) in a solvent (disclosed in, for example, Japanese patent application publication (JP-B) No. 44-19274).

In the present invention, either (a) the acid chloride method or (b) the isocyanate method may be used. Each production method will be described with an example of aromatic polyamideimides, which is preferably used, as follows.

(a) Acid Chloride Method

As the derivative halide of a trivalent carboxylic acid compound having an acid anhydride group, compounds represented by Structural Formula (2) or (3) can be used.

Structural Formula (2)

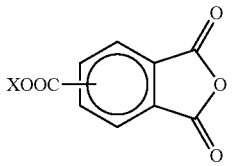

In Structural Formula (2), X represents a halogen atom.

Structural Formula (3)

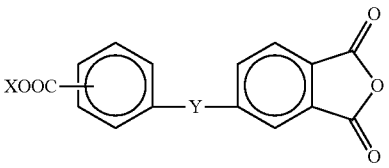

In Structural Formula (3), X represents a halogen atom, Y represents a single bond, —$CH_2$—, —CO—, —$SO_2$— or —O—.

Examples of the halogen atom in Structural Formula (2) or (3) include a fluorine atom, a chlorine atom, and a bromine atom. The chlorine atom is preferably used. Typically, trimellitic anhydride chloride is used.

The derivative halide of the trivalent carboxylic acid compound having an acid anhydride group represented by Structural Formula (2) or (3) is an example of raw materials for obtaining the aromatic polyamideimides. The derivative halides of the trivalent carboxylic acid compound having an acid anhydride group is not limited thereto.

Other than the aromatic trivalent carboxylic acid compounds represented by Structural Formula (2) or (3), derivative halides of aliphatic trivalent carboxylic acid compound having an acid anhydride group can be used, and may be used in combination with aromatic derivatives.

On the other hand, in the acid chloride method, the diamines to be reacted with the aromatic polycarboxylic anhydrides are not particularly limited and can be appropriately selected depending on the intended purpose. Examples thereof include aromatic diamines, aliphatic diamines, and alicyclic diamines. Of these, aromatic diamines are preferably used.

Examples of the aromatic diamines include m-phenylenediamine, p-phenylenediamine, oxydianiline, diamino-m-xylylene, diamino-p-xylylene, 1,4-napthalenediamine, 1,5-napthalenediamine, 2,6-napthalenediamine, 2,7-napthalenediamine, 2,2'-bis-(4-aminophenyl)propane, 2,2'-bis-(4-aminophenyl)hexafluoropropane, 4,4'-diaminodiphenyl sulfone, 4,4'-diaminodiphenyl ether, 3,3'-diaminodiphenyl sulfone, 3,3'-diaminodiphenyl ether, 3,4-diaminobiphenyl, 4,4'-diaminobenzophenone, 3,4-diaminodiphenyl ether, isopropylidenedianiline, 3,3'-diaminobenzophenone, o-tolidine, 2,4-tolylenediamine, 1,3-bis-(3-aminophenoxy)benzene, 1,4-bis-(4-aminophenoxy)benzene, 1,3-bis-(4-aminophenoxy)benzene, 2,2-bis-[4-(4-aminophenoxy)phenyl]propane, bis-[4-(4-aminophenoxy)phenyl]sulfone, bis-[4-(3-aminophenoxy)phenyl]sulfone, 4,4'-bis-(4-aminophenoxy)biphenyl, 2,2'-bis-[4-(4-aminophenoxy)phenyl]hexafluoropropane, 4,4'-diaminodiphenyl sulfide, and 3,3'-diaminodiphenyl sulfide.

Examples of the aliphatic diamines include methylene diamine, and hexafluoroisopropylidene diamine.

By using a siloxane compound having an amino group at both ends thereof as diamine, a silicone-modified polyamideimide resin can be prepared. Examples of the siloxane compound include 1,3-bis(3-aminopropyl)-1,1,3,3-tetramethyldisiloxane, α,ω-bis(3-aminopropyl)-polydimethylsiloxane, 1,3-bis(3-aminophenoxymethyl)-1,1,3,3-tetramethyldisiloxane, α,ω-bis(3-aminophenoxymethyl) polydimethylsiloxane, 1,3,-bis(2-(3-aminophenoxy)ethyl)-1,1,3,3-tetramethyldisiloxane, α,ω-bis(2-(3-aminophenoxy) ethyl)polydimethylsiloxane, 1,3-bis(3-(3-aminophenoxy) propyl)-1,1,3,3-tetramethyldisiloxane, and α,ω-bis(3-(3-aminophenoxy)propyl)polydimethylsiloxane.

In order to obtain polyamideimide (polyamideimide resin) in the present invention by the acid chloride method, in the same manner as in the production of the polyimide resin, the derivative halide of the trivalent carboxylic acid compound having an acid anhydride group and the diamine are dissolved in an organic polar solvent, and then reacted at a low temperature (0° C. to 30° C.) to form a polyamideimide resin precursor (polyamide-amic acid), and then the polyamideimide resin precursor is transformed into polyamideimide (i.e., imidization).

The organic polar solvent is not particularly limited as long as it solves polyamide-amic acid, and the same organic polar solvents as those used in the polyimide can be used. Examples thereof include sulfoxide solvents (e.g., dimethyl sulfoxide, diethyl sulfoxide), formamide solvents (e.g., N,N-dimethyl formamide, N,N-diethyl formamide), acetamide solvents (e.g., N,N-dimethyl acetamide, N,N-diethyl acetamide), pyrrolidone solvents (e.g., N-methyl-2-pyrrolidone, N-vinyl-2-pyrrolidone), phenol solvents (e.g., phenol, o-, m-, or p-cresol, xylenol, phenol halide, catechol), ether solvents (e.g., tetrahydrofuran, dioxane, dioxolan), alcohol solvents (e.g., methanol, ethanol, butanol), cellosolve solvents (e.g., butyl cellosolve), and hexamethylphosphoramide, and γ-butyrolactone.

These may be used alone or in combination. Of these, N,N-dimethyl acetamide, and N-methyl-2-pyrrolidone are particularly preferable.

The thus obtained polyamide/polyamic acid (polyamide-amic acid) solution is applied to a support (or a mold), and the coated liquid is then subjected to a treatment such as heating. Thus, the polyamide-amic acid is transformed into polyamideimide (polyamideimide) (i.e., imidization).

Examples of the imidization include a method of inducing dehydration ring-closing reaction by heating in the same manner as in the polyimide, and a method of chemically ring closing using a dehydrating/ring-closing catalyst.

When the dehydration ring-closing reaction is performed by heating, the reaction temperature is preferably 150° C. to 400° C., and more preferably 180° C. to 350° C. The heat treatment time is preferably 30 seconds to 10 hours, and more preferably 5 minutes to 5 hours. When the dehydrating/ring-closing catalyst is used, the reaction temperature is preferably 0° C. to 180° C., more preferably 10° C. to 80° C. The reaction time is preferably several tens minutes to several days, more preferably 2 hours to 12 hours. Examples of the dehydrating/ring-closing catalyst include acid anhydrides such as acetic acid, propanoic acid, butyric acid, and benzoic acid.

(b) Isocyanate Method

Examples of the trivalent carboxylic acid compound having an acid anhydride group and a carboxylato group (derivative of the trivalent carboxylic acid compound having an acid anhydride group) in the isocyanate method include compounds represented by Structural Formula (4) or (5).

Structural Formula (4)

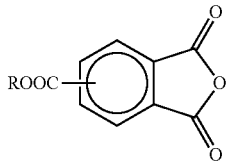

In Structural Formula (4), R denotes a hydrogen atom, an alkyl or phenyl group having 1 to 10 carbon atoms.

Structural Formula (5)

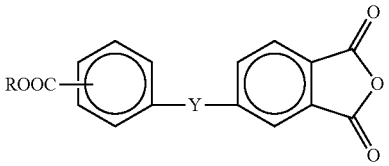

In Structural Formula (5), R denotes a hydrogen atom, an alkyl or phenyl group having 1 to 10 carbon atoms; Y denotes a single bond, —$CH_2$—, —CO—, —$SO_2$— or —O—.

Any derivatives represented by Structural Formula (4) or (5) can be used, and trimellitic anhydride is typically used. The derivatives of the trivalent carboxylic acid compound having an acid anhydride group may be used alone or in combination depending on the intended purpose.

The derivative of the trivalent carboxylic acid compound having an acid anhydride group and a carboxylato group represented by Structural Formula (4) or (5) is an example of raw materials for obtaining aromatic polyamideimides. The derivative of the trivalent carboxylic acid compound having an acid anhydride group and a carboxylato group is not limited thereto.

Other than the aromatic trivalent carboxylic acid compounds represented by Structural Formula (4) or (5), aliphatic trivalent carboxylic acid compounds can be used. For example, the aliphatic trivalent carboxylic acid compounds can be used in combination with the aromatic carboxylic acid compounds.

Next, in the isocyanate method, the trivalent carboxylic acid compound having an acid anhydride group and a carboxylato group reacts with an isocyanate compound. Examples of the isocyanate compound include 4,4'-diphenylmethane diisocyanate, tolylene diisocyanate, xylene diisocyanate, 4,4'-diphenyl ether diisocyanate, 4,4'-[2,2-bis(4-phenoxyphenyl)propane]diisocyanate, biphenyl-4,4'-diisocyanate, biphenyl-3,3'-diisocyanate, biphenyl-3,4'-diisocyanate, 3,3'-dimethylbiphenyl-4,4'-diisocyanate, 2,2'-dimethylbiphenyl-4,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

As the isocyanate compound, an aromatic isocyanate compound (aromatic polyisocyanate) is particularly preferably used. These aromatic polyisocyanates may be used alone or in combination.

Moreover, as necessary, aliphatic, alicyclic isocyanates, such as hexamethylene diisocyanate, 2,2,4-trimethylhexamethylene diisocyanate, isophorone diisocyanate, 4,4'-dicyclohexylmethane diisocyanate, transcyclohexane-1,4-diisocyanate, hydrogenated m-xylene diisocyanate, and lysine diisocyanate, and trivalent or higher functional polyisocyanates can be also used.

In order to obtain polyamideimide used in the present invention by the isocyanate method, in the same manner as in the production of the polyimide, a solution containing a polyamideimide precursor prepared by dissolving the derivative of the trivalent carboxylic acid compound having an acid anhydride group and the aromatic polyisocyanate in an organic polar solvent is applied to a support (or a mold), and then the coated liquid is heated, so as to transform the polyamideimide precursor into polyamideimide. When the polyamideimide precursor is transformed into polyamideimide by the isocyanate method, carbon dioxide is generated to form polyamideimide without forming an intermediate product such as polyamic acid.

Reaction Formula (6) represents an example of formation of aromatic polyamideimide (polyamideimidization) by using trimellitic anhydride and aromatic diisocyanate.

Reaction Formula (6)

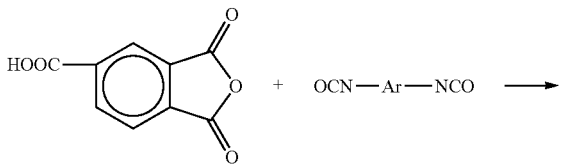

-continued

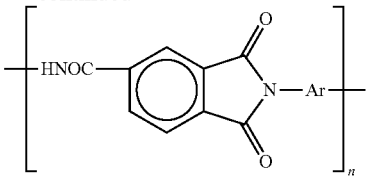

In Reaction Formula (6), Ar denotes a divalent aromatic group.

As the precursor transformed into polyimide and polyamideimide, a precursor obtained by reacting a single component used as a raw material is usually used. If necessary, a precursor obtained by reacting other components as raw materials selected from the standpoint of compatibility can be used in combination with the precursor obtained by reacting a single component. Moreover, copolymers having a polyimide repeat unit and a polyamideimide repeat unit may be used as the precursor.

<Resin Layer>

Next, description will be given to a resin layer 21 laminated on the base layer 11.

The material for the resin layer may be, for example, commonly used resins, elastomer and rubbers. Preferred are materials having sufficient flexibility (elasticity) that the effects of the present invention can be obtained. Elastomer materials and rubber materials may be used.

Examples of the elastomer materials include thermoplastic elastomers and thermosetting elastomers. Examples of the thermoplastic elastomers include polyesters, polyamides, polyethers, polyurethanes, polyolefins, polystyrenes, polyacryls, polydienes, silicone-modified polycarbonates and fluorine-containing copolymers. Examples of the thermosetting elastomers include polyurethanes, silicone-modified epoxys and silicone-modified acryls.

Examples of the rubber materials include isoprene rubbers, styrene rubbers, butadiene rubbers, nitrile rubbers, ethylene propylene rubbers, butyl rubbers, silicone rubbers, chloroprene rubbers, acryl rubbers, chlorosulfonated polyethylenes, fluorine-containing rubbers, urethane rubbers and hydrin rubbers.

Materials with which appropriate performances can be obtained are appropriately selected from the above-listed various elastomers and rubbers. In the present invention, thermosetting materials are preferably used as compared with thermoplastic materials, since a spherical resin particle layer can be favorably formed. The thermosetting materials are more excellent in adhesion to resin particles by virtue of functional groups contributing to the curing reaction, and thus can reliably fix the resin particles. Similarly, vulcanized rubbers are preferred.

Also, additional materials are appropriately incorporated into the selected material from the above, if necessary. Examples of the additional materials include resistance controlling agents for controlling electrical characteristics, flame retardants for imparting flame retardancy, antioxidants, reinforcing agents, fillers and vulcanization promoters.

The resistance controlling agents for controlling electrical characteristics may be the above-described materials. However, carbon black, metal oxides or other materials impair flexibility, and thus, the amounts of them are preferably lowered. Further, an ion conducting agent or a conductive polymer is advantageously used. These materials may be used in combination.

The resistance of the resin layer is preferably adjusted to $1\times10^{8}$ Ω/square to $1\times10^{13}$ Ω/square in terms of surface resistance, and to $1\times10^{6}$ Ω·cm to $1\times10^{12}$ Ω·cm in terms of volume resistance.

The thickness of the resin layer (film) is preferably about 200 μm to about 2 mm. When the thickness thereof is small, followability to surface irregularities of a recording medium and the transfer pressure-reducing effect is lowered, which is not preferred. When the thickness thereof is too large, the mass of the film becomes large. As a result, the film may be warped and unstable in running. Cracks tend to occur at part of the belt where it is curved around rollers so as to wound the rollers.

<Spherical Resin Particles>

Next, description will be given to spherical resin particles provided in the surface of the resin layer.

The material of the spherical resin particles is not particularly limited. Examples thereof include spherical particles composed mainly of acrylic resins, melamine resins, polyamide resins, polyester resins, silicone resins and fluorine-containing resins. These spherical particles may be subjected to surface treatment with other materials.

Also, the resin particles referred to here also include rubber materials. There are applicable spherical particles made of rubber materials and coated with a hard resin layer.

Moreover, the spherical resin particles may be hollow or porous.

Of these resins, silicone resin particles are most preferable, since they have lubricity and high functions of imparting releasability and abrasion resistance to the toner.

Preferred are particles shaped to be spherical by the polymerization method using these resins. In the present invention, the particles are preferably more spherical.

The particle diameter of the particles is 0.5 μm to 5 μm in terms of volume average particle diameter. Preferably, the particles are monodispersed particles. The monodispersed particles as used here do not refer to particles having a single particle diameter but particles having an extremely sharp particle size distribution.

Specifically, the distribution range of the particles may be within ±(the average particle diameter×0.5) μm.

When the particle diameter is 0.5 μm or smaller, the particles do not sufficiently exhibit the effect of improving transfer performance. When the particle diameter is 5.0 μm or greater, the surface roughness of the particles becomes large, and the interparticle spaces becomes large also. As a result, the toner cannot be transferred satisfactorily, and cleaning failures arise.

Furthermore, most particles are insulating, and when the particle diameter of the particles is too large, the charge potential remains and accumulates by the particles, causing image failures due to the accumulation of the potential during continuous output of images.

<Surface Conditions of Belt>

Next, description will be given to the surface conditions of a belt of the present invention.

Figure 2A:
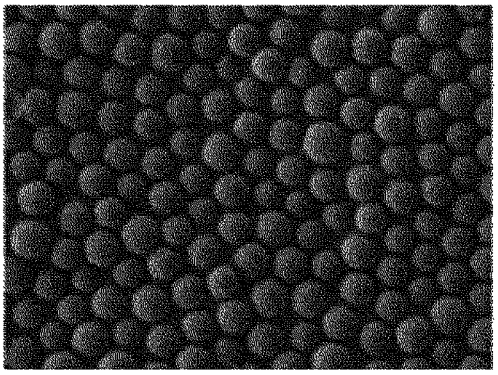
FIG. 2A is an electron microscope image of the surface of an intermediate transfer belt of the present invention.
Figure 2B:
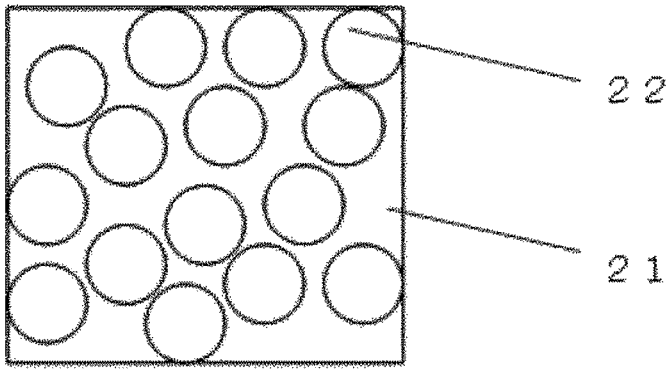
FIG. 2B is a schematic sketch of the electron microscope image of FIG. 2A.

FIG. 2A is an electron microscope image of the surface of a belt observed from directly above. FIG. 2B is an enlarged schematic sketch of the electron microscope image of FIG. 2A. As shown in FIGS. 2A and 2B, spherical particles having a uniform particle diameter are independently and orderly arranged. Stacked resin particles are not virtually observed.

At the surface of the resin layer, the diameter of the cross-section of each particle is preferably more uniform. Specifically, it is preferably in the distribution range of ±(the average particle diameter×0.5)μm.

As described above, monodispersed particles are used to form such a resin layer. However, other particles than monodispersed particles may be used so that the diameters of the cross-sections of the particles at the surface fall within the distribution range.

Figure 3A:
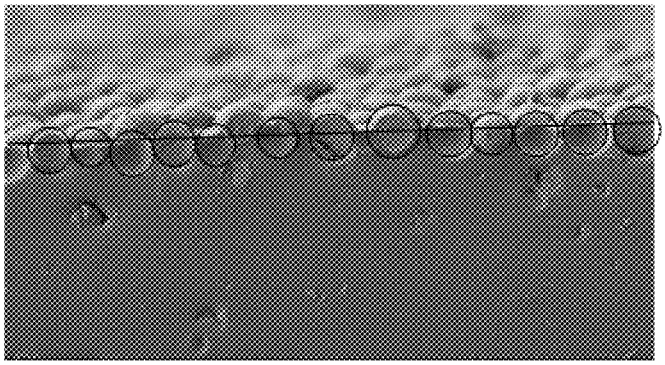
FIG. 3A is an electron microscope image of the cross-section of the surface layer of an intermediate transfer belt of the present invention.
Figure 3B:
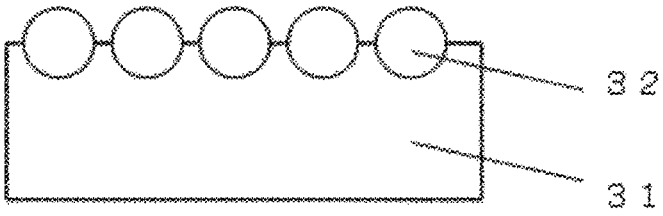
FIG. 3B is a schematic sketch of the electron microscope image of FIG. 3A.

FIG. 3A is an electron microscope image of the cross-section of the surface of a belt. FIG. 3B is an enlarged schematic sketch of the electron microscope image of FIG. 3A.

In the present invention, the spherical resin particles are partially embedded in the resin layer. The embedment rate of the spherical resin particles is preferably higher than 50% but lower than 100%, more preferably 51% to 90%. When the embedment rate is 50% or lower, the particles are easily exfoliated during long-term use in electrophotographic apparatuses, leading to poor durability. When the embedment rate is 100%, the transfer pressure-reducing effect is lowered, which is not preferred.

As used herein, "the embedment rate" refers to a rate of part where each particle is embedded in the resin layer in the thickness direction of the resin layer. Here, the description "the embedment rate is higher than 50% but lower than 100%" means that the average embedment rate of the particles in a certain field of view is higher than 50% but lower than 100%, not that all the particles are embedded at an embedment rate which is higher than 50% but lower than 100%. However, when the embedment rate of the particles is 50%, the particles completely embedded in the resin layer cannot be virtually observed in the electron microscopic cross-sectional image (i.e., the particles completely embedded in the resin layer are equal to or lower than 5% by number relative to the total particles).

Furthermore, preferably, the particles are uniformly embedded in the thickness direction of the resin layer.

Figure 7:
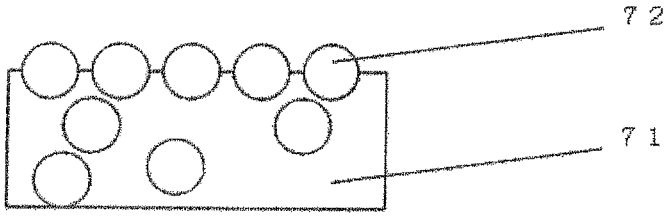
FIG. 7 is a schematic view of an unfavorable surface layer of a conventional intermediate transfer belt.

As shown in FIG. 7, when a plurality of particles 72 are stacked in the thickness direction of layer 71, the distribution of the particles becomes non-uniform. As a result, electrical characteristics of the belt surface become also non-uniform due to the electrical resistance of each particle, causing image failures. Specifically, the electrical resistance becomes increased in regions where many particles exist. In these regions, the surface potential is generated due to the residual charge, causing a variation in surface potential on the belt surface. Image failures may be caused between these regions and the adjacent regions, such as differences in image density.

Figure 8:
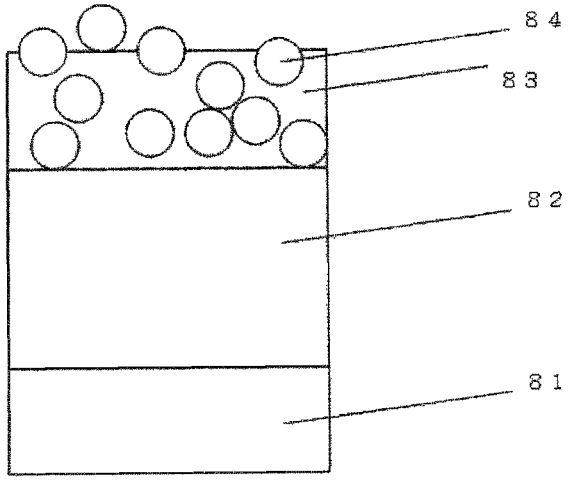
FIG. 8 is a schematic view of an unfavorable cross-sectional surface of the surface layer of a conventional intermediate transfer belt.

Also, as shown in FIG. 8, when some particles 84 are exposed on the resin layer surface 83 and some particles are completely embedded in the resin layer, it is difficult to form a particle monolayer.

Also, as shown in FIG. 8, when some particles are exposed on the resin layer surface and some particles are completely embedded in the resin layer, it is difficult to form a particle monolayer.

Next, description will be given to one exemplary method for producing a belt of the present invention having the above-described configuration.

First, description will be given to a method for producing a base layer using a coating liquid containing at least a resin component; i.e., the above polyimide or polyamideimide resin precursor in the present invention.

Specifically, while a cylindrical mold (e.g., a cylindrical metal mold) is being slowly rotated, a coating liquid containing at least a resin component (e.g., a coating liquid containing a polyimide or polyamideimide resin precursor) is uniformly coated or flow-cast on the entire outer surface of the cylindrical mold with a liquid-supplying device such as a nozzle and a disperser (to thereby form a coat film).

Then, the rotation speed is increased to a predetermined value, at which the rotation speed is maintained constant for a desired period. Subsequently, the temperature is gradually increased while the cylindrical mold is being rotated, whereby the solvent is evaporated from the coat film at a temperature of about 80° C. to about 150° C. In this process, preferably, the vapor in the atmosphere (e.g., vaporized solvent) is removed through efficient circulation. When a self-supporting film is formed, the self-supporting film is placed together with the mold in a heating furnace (baking furnace) which can perform high-temperature treatment. The temperature of the furnace is gradually increased, and the mold is treated at a high temperature (baked) at the final temperature of about 250° C. to about 450° C., to thereby sufficiently imidizing or polyamideimidizing the polyimide or polyamideimide resin precursor.

<Method for Processing Belt Surface>

After thorough cooling, a resin layer is laminated on the base layer.

The resin layer can be formed on the base layer through, for example, injection molding or extrusion molding. In the present invention, it is advantageous that the resin layer is formed through coating of a resin coating liquid.

The resin coating liquid can be prepared from, for example, a liquid resin, a liquid elestomer or a liquid rubber. Also, the resin coating liquid may be a solution prepared by dissolving, in a solvent, a resin, an elastomer or a rubber which are soluble in the solvent. Here, description will be given to a method for coating the base layer with a thermosetting, liquid elastomer. Similar to the formation of the base layer, while the cylindrical metal mold is being slowly rotated, a coating liquid containing at least the thermosetting, liquid elastomer is uniformly coated or flow-cast on the entire surface of the base layer with a liquid-supplying device such as a nozzle and a disperser (to thereby form a coat film).

Figure 4:
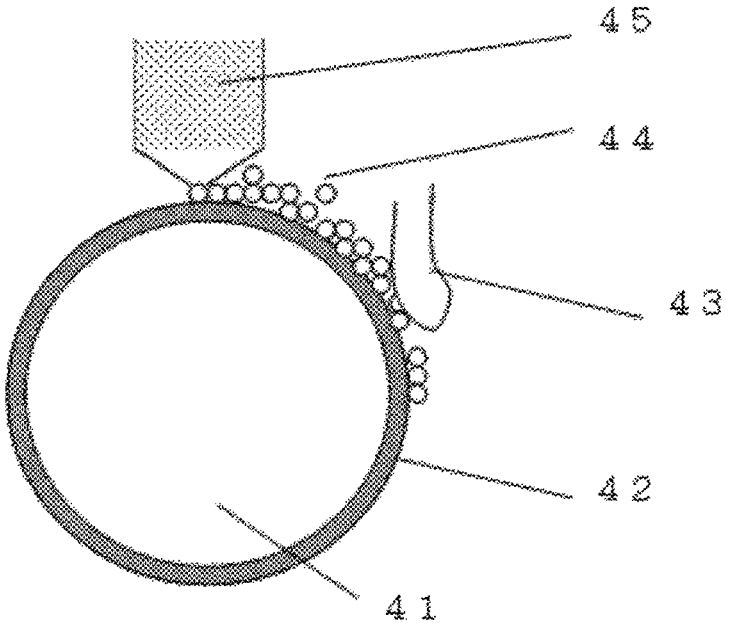
FIG. 4 illustrates a method for producing a resin layer having a uniform concavo-convex pattern formed by spherical resin particles independently arranged along the layer surface so as to form a particle monolayer, in a belt having the configuration of the present invention.

Thereafter, the rotation speed is increased to a predetermined value, at which the rotation speed is maintained constant for a desired period. After the resultant layer has been sufficiently leveled, as illustrated in FIG. 4, spherical particles are uniformly applied onto the layer surface using a powder-supplying device 45 while the cylindrical mold is being rotated. Then, a press member 43 is pressed against the thus-applied spherical particles on the layer surface at a constant pressure. Pressing by the press member 43 embeds the spherical particles in the resin layer while removing the extra particles. In the present invention, monodispersed spherical particles are used among others, and thus, a uniform particle monolayer can be formed in a simple manner through only such a leveling step using the press member.

Although the embedment rate of the particles in the resin layer may be controlled by other methods, the embedment rate can be readily controlled by increasing or decreasing the press force of the press member 43, for example. The press force depends on the viscosity of a flow-cast liquid, the resin content, the amount of a solvent used and the type of the resin. As one example, when the viscosity of the flow-cast liquid is in the range of 100 mPa·s to 100,000 mPa·s, the press force is adjusted so as to fall within a range of 1 mN/cm to 1,000 mN/cm. In this case, the particles can be relatively easily embedded in the resin layer at an embedment rate higher than 50% but lower than 100%.

After the formation of the uniform particle layer, the resin coating liquid is heated for curing at a predetermined temperature for a predetermined time while the cylindrical mold is being rotated, whereby a resin layer is formed.

After thorough cooling, the resin layer is separated from the metal mold together with the base layer, to thereby a seamless belt (intermediate transfer belt) of interest.

The seamless belt produced by the above-described method can be suitably used as an intermediate transfer belt mounted to a so-called intermediate transfer-based image forming apparatus, in which a plurality of color toner-developed images are sequentially formed on image bearing members, and then primarily transferred onto and sequentially superposed on an intermediate transfer belt, and the resultant primarily-transferred image is secondarily transferred onto a recording medium at one time, to thereby provide an electrophotographic apparatus (image forming apparatus) capable of forming high-quality images.

Referring now to the schematic views of essential parts, detail description will next be given to a seamless belt used in the belt constitution section of an image forming apparatus of the present invention. Note that the schematic views are exemplary ones, which should not be construed as limiting the present invention thereto.

Figure 5:
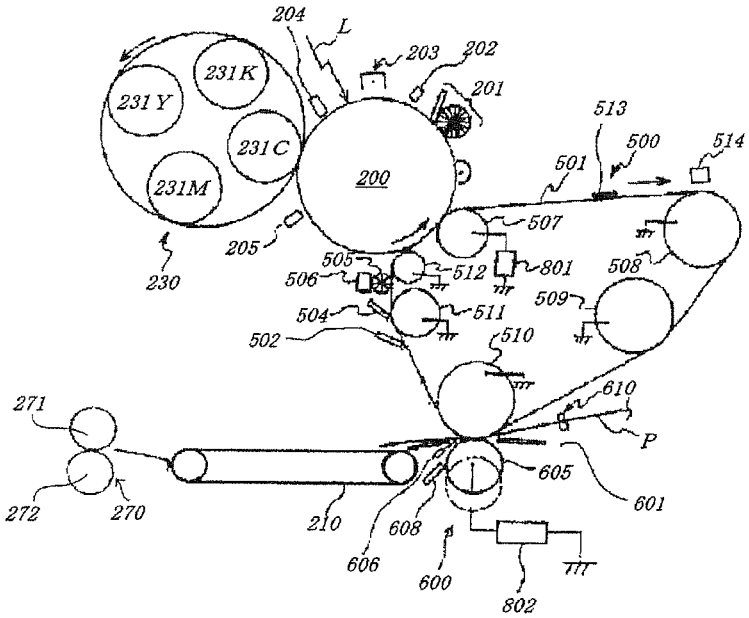
FIG. 5 schematically illustrates essential parts of an image forming apparatus containing as a belt member an intermediate transfer belt (seamless belt) produced by a production method of the present invention.

FIG. 5 is schematic diagram of a main section for illustrating electrophotographic apparatus including a seamless belt used as a belt member obtained by the production method according to the present invention.

As shown in FIG. 5, an intermediate transfer unit 500 including a belt member, includes an intermediate transfer belt 501 as an intermediate transfer medium stretched around a plurality of rollers. Around the intermediate transfer belt 501, a secondary transfer bias roller 605 serving as a secondary transfer charge applying unit of a secondary transfer unit 600, a belt cleaning blade 504 as a cleaning unit for the intermediate transfer medium, and a lubricant applying brush 505 as a lubricant applying member of a lubricant applying unit, etc. are disposed facing the intermediate transfer belt 501.

A position detecting mark 513 is formed on an outer (FIG. 5) or inner surface of the intermediate transfer belt 501. When the position detecting mark 513 is formed on the outer surface of the intermediate transfer belt 501, it is preferred that the mark be located at a position so as not to come into contact with the cleaning blade 504. When this structure is hard to achieve, the mark may be formed on an inner surface of the intermediate transfer belt 501. An optical sensor 514 serving as a sensor for detecting marks, is arranged at a location between a primary transfer bias roller 507 and a belt driving roller 508, which rollers support the intermediate transfer belt 501.

The intermediate transfer belt 501 is stretched around the primary transfer bias roller 507 serving as a primary transfer charge applying unit, the belt driving roller 508, a belt tension roller 509, a secondary transfer opposing roller 510, a cleaning opposing roller 511, and a feedback current detecting roller 512. Each roller is formed of a conductive material, and respective rollers other than the primary transfer bias roller 507 are grounded. A transfer bias is applied to the primary transfer bias roller 507, the transfer bias being controlled at a predetermined level of current or voltage according to the number of superimposed toner images by means of a primary transfer power source 801 controlled at a constant current or a constant voltage.

The intermediate transfer belt 501 is driven in the direction indicated by an arrow by the belt driving roller 508, which is driven to rotate in the direction indicated by an arrow by a driving motor (not shown).

The intermediate transfer belt 501 serving as the belt member is generally semiconductive or insulative, and has a single layer or a multi layer structure. In the present invention, a seamless belt is preferably used, so as to improve durability and attain excellent image formation. Moreover, the intermediate transfer belt is larger than the maximum size capable of passing paper so as to superimpose toner images formed on a photoconductor drum 200.

The secondary transfer bias roller 605 is a secondary transfer unit, which is configured to be brought into contact with a portion of the outer surface of the intermediate transfer belt 501, which is stretched around the secondary transfer opposing roller 510 by means of an attaching/detaching mechanism as an attaching/detaching unit described below. The secondary transfer bias roller 605 which is disposed so as to hold a transfer paper P with a portion of the intermediate transfer belt 501 which is stretched around the secondary transfer opposing roller 510, is applied with a transfer bias of a predetermined current by the secondary transfer power source 802 controlled at a constant current.

A pair of registration rollers 610 feeds the transfer paper P as a transfer medium at a predetermined timing in between the secondary transfer bias roller 605 and the intermediate transfer belt 501 stretched around the secondary transfer opposing roller 510. With the secondary transfer bias roller 605, a cleaning blade 608 as a cleaning unit is in contact. The cleaning blade 608 performs cleaning by removing deposition deposited on the surface of the secondary transfer bias roller 605.

In a color copying machine having the above-mentioned construction, when an image formation cycle is started, the photoconductor drum 200 is rotated by a driving motor (not shown) in a counterclockwise direction indicated by an arrow, so as to form Bk (black), C (cyan), M (magenta), and Y (yellow) toner images on the photoconductor drum 200. The intermediate transfer belt 501 is driven in the direction of the arrow by means of the belt driving roller 508. Along with the rotation of the intermediate transfer belt 501, a formed Bk-toner image, a formed C-toner image, a formed M-toner image, and a formed Y-toner image are primarily transferred by means of a transfer bias based on a voltage applied to the primary transfer bias roller 507. Finally, the images are superimposed on one another in order of Bk, C, M, and Y on the intermediate transfer belt 501, to thereby form a color image.

For example, the Bk toner image is formed as follows.

In FIG. 5, a charger 203 uniformly charges a surface of the photoconductor drum 200 to a predetermined potential with a negative charge by corona discharging. Subsequently, at a timing determined based on signals for detecting marks on the belt, by the use of an optical writing unit 204 raster exposure is performed based on a Bk color image signal. When the raster image is exposed, a charge proportional to an amount of light exposure is removed and a Bk latent electrostatic image is thereby formed, in an exposed portion of the photoconductor drum 200 which has been uniformly charged. Then, by bringing a Bk toner charged to a negative polarity on the Bk developing roller of a Bk developing unit 231K into contact with the Bk latent electrostatic image, the Bk toner does not adhere to a portion where a charge remaining on the photoconductor drum 200, and the Bk toner adsorbs to a portion where there is no charge on the photoconductor drum 200, in other words a portion exposed to the raster light exposure, to thereby form a Bk toner image corresponding to the latent electrostatic image.

The Bk toner image formed on the photoconductor drum 200 is primarily transferred to the outer surface of the intermediate transfer belt 501 being in contact with the photoconductor drum 200, in which the intermediate transfer belt 501 and the photoconductor drum 200 are driven at an equal speed. After primary transfer, slightly remaining toner which has not been transferred from the photoconductor drum 200 to the intermediate transfer belt 501 is cleaned with a photoconductor cleaning unit 201 in preparation for a next image forming operation on the photoconductor drum 200. Next to the Bk image forming process, the operation of the photoconductor drum 200 then proceeds to a C image forming process, in which C image data is read with a color scanner at a predetermined timing, and a C latent electrostatic image is formed on the photoconductor drum 200 by a write operation with laser light based on the C image data.

A revolver development unit 230 is rotated after the rear edge of the Bk latent electrostatic image has passed and before the front edge of the C latent electrostatic image reaches, and the C developing unit 231C is set to a developing position, where the C latent electrostatic image is developed with C toner. From then on, development is continued over the area of the C latent electrostatic image, and at the point of time when the rear edge of the C latent electrostatic image has passed, the revolver development unit rotates in the same manner as the previous case of the Bk developing unit 231K to allow the M developing unit 231M to move to the developing position. This operation is also completed before the front edge of a Y latent electrostatic image reaches the developing position. As for M and Y image forming steps, the operations of scanning respective color image data, the formation of latent electrostatic images, and their development are the same as those of Bk and C, therefore, explanation of the steps is omitted.

Bk, C, M, and Y toner images sequentially formed on the photoconductor drum 200 are sequentially registered in the same plane and primarily transferred onto the intermediate transfer belt 501. Accordingly, the toner image whose four colors at the maximum are superimposed on one another is formed on the intermediate transfer belt 501. The transfer paper P is fed from the paper feed section such as a transfer paper cassette or a manual feeder tray at the time when the image forming operation is started, and waits at the nip of the registration rollers 610.

The registration rollers 610 are driven so that the front edge of the transfer paper P along a transfer paper guide plate 601 just meets the front edge of the toner image when the front edge of the toner image on the intermediate transfer belt 501 is about to reach a secondary transfer section where the nip is formed by the secondary transfer bias roller 605 and the intermediate transfer belt 501 stretched around the secondary transfer opposing roller 510, and registration is performed between the transfer paper P and the toner image.

When the transfer paper P passes through the secondary transfer section, the four-color superimposed toner image on the intermediate transfer belt 501 is collectively transferred (secondary transfer) onto the transfer paper P by transfer bias based on the voltage applied to the secondary transfer bias roller 605 by the secondary transfer power source 802. When the transfer paper P passes through a portion facing a transfer paper discharger 606 formed of charge eliminating spines and disposed downstream of the secondary transfer section in a moving direction of a transfer paper guiding plate 601, a charge on the transfer paper sheet is removed and then the transfer paper P is separated from the transfer paper guiding plate 601 to be delivered to a fixing unit 270 via the belt transfer unit 210 which is included in the belt constitution section (see FIG. 5). Furthermore, a toner image is then fused and fixed on the transfer paper P at a nip portion between fixing rollers 271 and 272 of the fixing unit 270, and the transfer paper P is then discharged outside of a main body of the apparatus by a discharging roller (not shown) and is stacked in a copy tray (not shown) with a front side up. The fixing unit 270 may have a belt constitution section.

On the other hand, the surface of the photoconductor drum 200 after the toner images are transferred to the belt is cleaned by the photoconductor cleaning unit 201, and is uniformly discharged by a discharge lamp 202. After the toner image is secondarily transferred to the transfer paper P, the toner remaining on the outer surface of the intermediate transfer belt 501 is cleaned by the belt cleaning blade 504. The belt cleaning blade 504 is configured to be brought into contact with the outer surface of the intermediate transfer belt 501 at a predetermined timing by the cleaning member attaching/detaching mechanism not shown in the figure.

On an upstream side from the belt cleaning blade 504 with respect to the rotating direction of the intermediate transfer belt 501, a toner sealing member 502 is provided so as to be brought into contact with the outer surface of the intermediate transfer belt 501. The toner sealing member 502 is configured to receive the toner particles scraped off with the belt cleaning blade 504 during cleaning of the remaining toner, so as to prevent the toner particles from being scattered on a conveyance path of the transfer paper P. The toner sealing member 502, together with the belt cleaning blade 504, is brought into contact with the outer surface of the intermediate transfer belt 501 by the cleaning member attaching/detaching mechanism.

To the outer surface of the intermediate transfer belt 501 from which the remaining toner has been removed, a lubricant 506 is applied by scraping it with a lubricant applying brush 505. The lubricant 506 is formed of zinc stearate, etc. in a solid form, and disposed to be brought into contact with the lubricant applying brush 505. The charge remaining on the outer surface of the intermediate transfer belt 501 is removed by discharge bias applied with a belt discharging brush (not shown), which is in contact with the outer surface of the intermediate transfer belt 501. The lubricant applying brush 505 and the belt discharging brush are respectively configured to be brought into contact with the outer surface of the intermediate transfer belt 501 at a predetermined timing by means of an attaching/detaching mechanism (not shown).

When the copying operation is repeated, in order to perform an operation of the color scanner and an image formation onto the photoconductor drum 200, an operation proceeds to an image forming process of a first color (Bk) of a second sheet at a predetermined timing subsequent to an image forming process of the fourth color (Y) of the first sheet. As for the intermediate transfer belt 501, a Bk toner image of the second sheet is primarily transferred to the outer surface of the intermediate transfer belt 501 in an area of which has been cleaned by the belt cleaning blade 504 subsequent to a transfer process of the toner image of four colors on the first sheet of the transfer paper. Then, the same operations are performed for a next sheet as for the first sheet. Operations have been described in a copy mode in which full-color copies of four colors are obtained. The same operations are performed the number of corresponding times for specified colors in copy modes of three or two colors. In a monochrome-color copy mode, only the developing unit of a predetermined color in the revolver development unit 230 is put in a development active state until the copying operation is completed for the predetermined number of sheets, and the belt cleaning blade 504 is kept in contact with the intermediate transfer belt 501 while the copying operation is continuously performed.

In the above-mentioned embodiment, a copier having only one photoconductor drum 200 is described. However, the electrophotographic intermediate transfer belt of the present invention can be used, for example, in a tandem type image forming apparatus, in which a plurality of photoconductor drums are serially arranged along an intermediate transfer belt formed in the seamless belt.

Figure 6:
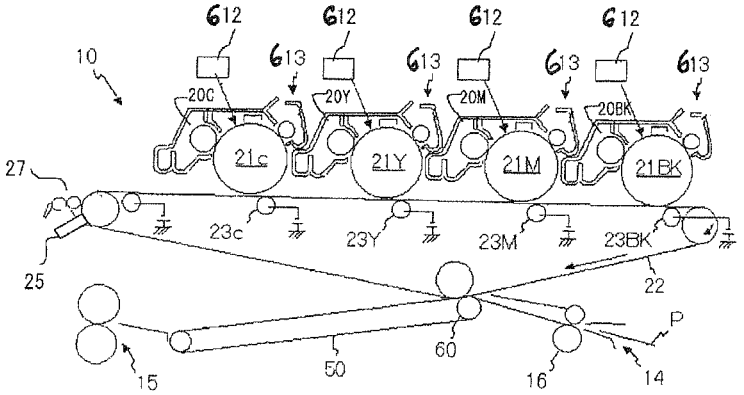
FIG. 6 schematically illustrates essential parts of one exemplary image forming apparatus in which a plurality of photoconductor drums are arranged along an intermediate transfer belt of the present invention.

Namely, FIG. 6 shows a structural example of a four-drum digital color printer having four photoconductor drums 21Bk, 21Y, 21M, and 21C for forming toner images of four colors (black, yellow, magenta, cyan).

In FIG. 6, a main body of a printer 10 is constituted with image writing sections 612, image forming sections 613, paper feeding sections 14, for electrophotographic color image formation. Based on image signals, image processing operation is performed in an image processing section, and converted to color signals of black (Bk), magenta (M), yellow (Y), and cyan (C), and then color signals are transmitted to the image writing sections 612. The image writing sections 612 are laser scanning optical systems each including a laser light source, a deflector such as a rotary polygon mirror, a scanning imaging optical system, and mirrors, and have four optical writing paths corresponding to color signals, and perform image writing corresponding to respective color signals on image bearing members (photoconductors) 21Bk, 21M, 21Y, 21C provided for respective colors in the image forming sections 613.

The image forming sections 613 includes four photoconductors 21Bk, 21M, 21Y and 21C serving as image bearing member for Black (Bk), magenta (M), yellow (Y) and cyan (C), respectively. Generally, organic photoconductors are used as these photoconductors. Around each of the photoconductors 21Bk, 21M, 21Y, 21C, a charging unit, an exposure portion irradiated with laser beam from the image writing section 612, each of developing units 20Bk, 20M, 20Y, 20C, each of primary transfer bias rollers 23Bk, 23M, 23Y, 23C as a primary transfer unit, a cleaning unit (abbreviated), and other devices such as a discharging unit for the photoconductor (not shown) are arranged. Each of the developing units 20Bk, 20M, 20Y, 20C uses a two component magnet brush developing method. An intermediate transfer belt 22, which is the belt constitution section, is located between each of the photoconductors 21Bk, 21M, 21Y, 21C and each of the primary transfer bias rollers 23Bk, 23M, 23Y, 23C. Black (Bk), magenta (M), yellow (Y) and cyan (C) color toner images formed on the photoconductors 21Bk, 21M, 21Y, 21C are sequentially superimposingly transferred to the intermediate transfer belt 22.

The transfer paper P fed from the paper feeding section 14 is fed via a registration roller 16 and then held by a transfer conveyance belt 50 as a belt constitution section. The toner images transferred onto the intermediate transfer belt 22 are secondarily transferred (collectively transferred) to the transfer paper P by a secondary transfer bias roller 60 as a secondary transfer unit at a point in which the intermediate transfer belt 22 is brought into contact with the transfer conveyance belt 50. Thus, a color image is formed on the transfer paper P. The transfer paper P on which the color image is formed is fed to a fixing unit 15 via the transfer conveyance belt 50, and the color image is fixed on the transfer paper P by the fixing unit 15, and then the transfer paper P is discharged from the main body of the printer.

Toner particles remaining on the surface of the intermediate transfer belt 22, which has not been transferred in the secondary transfer process, are removed by a belt cleaning member 25. On a downstream side from the belt cleaning member 25 with respect to the rotation direction of the intermediate transfer belt 22, a lubricant applying unit 27 is provided. The lubricant applying unit 27 includes a solid lubricant and a conductive brush configured to rub the intermediate transfer belt 22 so as to apply the solid lubricant to the surface of the intermediate transfer belt 22. The conductive brush is constantly in contact with the intermediate transfer belt 22, so as to apply the solid lubricant to the intermediate transfer belt 22. The solid lubricant is effective to improve the cleanability of the intermediate transfer belt 22, thereby preventing occurrence of filming thereon, and improving durability of the intermediate transfer belt 22.

EXAMPLES

Hereinafter, the present invention will be specifically described based on Examples, which shall not be construed as limiting the scope of the present invention. Modifications of Examples are also included within the scope of the present invention as long as they do not depart from the gist of the present invention.

Example 1

A base layer-coating liquid was prepared as follows, and was used to produce a base layer of a seamless belt.

<Preparation of Base-Layer Coating Liquid>

First, carbon black (SPECIAL BLACK 4, product of Evonik Degussa) was dispersed in N-methyl-2-pyrrolidone with a bead mill. The resultant dispersion liquid was added to polyimide varnish mainly containing a polyimide resin precursor (U-VARNISH A, product of UBE INDUSTRIES, LTD.) so that the carbon black content was adjusted to 17% by mass of the solid content of polyamic acid, followed by thoroughly stirring and mixing, to thereby prepare a coating liquid.

[Production of Seamless Belt]

Next, a metal cylinder (outer diameter: 100 mm, length: 300 mm) was subjected to blast treatment so as to have a rough surface, and then used as a mold. While the resultant cylindrical mold was being rotated at 50 rpm, the above base layer-coating liquid was uniformly flow-cast onto the outer surface of the cylindrical mold using a dispenser. At the point when all of a predetermined amount of the coating liquid was flow-cast and then uniformly spread on the outer surface of the cylindrical mold, the rotation speed was increased to 100 rpm. The resultant cylindrical mold was placed in a hot air-circulating dryer, and gradually heated to 110° C., followed by heating for 60 minutes. Moreover, the cylindrical mold was further heated to 200° C., followed by heating for 20 minutes. Subsequently, the rotation was stopped, and then the cylindrical mold was gradually cooled and taken out from the dryer. Thereafter, the cylindrical mold was placed in a heating furnace (baking furnace) which could perform high-temperature treatment, and was heated (baked) stepwise to 320° C., followed by heating for 60 minutes.

After thorough cooling, a resin layer-coating liquid prepared as follows was used to form a resin layer on the base layer.

<Preparation of Resin Layer-Coating Liquid>

[Preparation of Resin Layer-Coating Liquid]

First, the below-given materials were mixed together, and then thoroughly kneaded with a biaxial kneader, to thereby produce a masterbatch.

<Materials for Carbon Masterbatch A for Intermediate Layer>

Epoxy-silicone copolymer (ALBIFLEX 348, silicone content: 60% by mass, product of Nanoresins): 20 parts by mass Carbon black (VULCAN XC72, product of Cabot Co.): 100 parts by mass The carbon masterbatch A was mixed with the below-given materials, to thereby obtain a coating liquid.

<Materials for Resin Layer-Coating Liquid>

Carbon masterbatch A: 8 parts by mass

Epoxy-silicone copolymer (ALBIFLEX 348, silicone content: 60% by mass, product of Nanoresins): 40 parts by mass Methyltetrahydrophthalic anhydride (HN-2000, product of Hitachi Chemical Co., Ltd.): 8 parts by mass

[Formation of Resin Layer on Base Layer]

Similarly, the above resin layer-coating liquid was uniformly flow-cast on the above-formed polyimide base layer with a dispenser. The coating amount was set so that the final layer thickness was adjusted to 300 μm. At the point when all of a predetermined amount of the coating liquid was flow-cast and then uniformly spread on the outer surface of the cylindrical mold, spherical acryl resin particles (TECHNO POLYMER MBX-SS SERIES, volume average particle diameter: 1 μm, product of SEKISUI PLASTICS CO., LTD.) were used as the spherical resin particles and uniformly applied to the surface in a manner illustrated in FIG. 4. Then, a polyurethane rubber blade (press member) was pressed against the particles at a press force of 100 mN/cm, to thereby fix the particles on the resin layer.

After the entire belt had been treated as described above, the resultant product was placed in a hot air-circulating dryer while being rotated. Then, the product was heated to 120° C. at a temperature increasing rate of 4° C./min, followed by heating for 30 min. Further, the product was heated to 250° C. at a temperature increasing rate of 4° C./min, followed by heating for 120 min. After the heating had been stopped, the product was gradually cooled to ambient temperature. After thorough cooling, the resultant product was taken out from the mold to thereby obtain intermediate transfer belt A.

From an electron microscopic cross-sectional image of the resultant belt, the embedment rate of the particles in the resin layer was found to be 65%.

Example 2

The procedure of Example 1 was repeated, except that the spherical resin particles were changed to silicone resin particles (X-52-854, volume average particle diameter: 0.8 μm, product of Shin-Etsu Chemical Co., Ltd.), to thereby produce intermediate transfer belt B.

From an electron microscopic cross-sectional image of the produced belt, the embedment rate of the particles in the resin layer was found to be 53%.

Example 3

The procedure of Example 1 was repeated, except that the spherical resin particles were changed to silicone resin particles (TOSPEARL 120, volume average particle diameter: 2.0 μm, product of Momentive Performance Materials Inc.), to thereby produce intermediate transfer belt C.

From an electron microscopic cross-sectional image of the produced belt, the embedment rate of the particles in the resin layer was found to be 75%.

Example 4

The procedure of Example 1 was repeated, except that the spherical resin particles were changed to silicone resin particles (KMP701, volume average particle diameter: 3.5 μm, product of Shin-Etsu Chemical Co., Ltd.), to thereby produce intermediate transfer belt D.

From an electron microscopic cross-sectional image of the produced belt, the embedment rate of the particles in the resin layer was found to be 85%.

Example 5

The procedure of Example 1 was repeated, except that the spherical resin particles were changed to silicone resin particles (TOSPEARL 2000B, volume average particle diameter: 6.0 μm, product of Momentive Performance Materials Inc.), to thereby produce intermediate transfer belt E.

From an electron microscopic cross-sectional image of the produced belt, the embedment rate of the particles in the resin layer was found to be 78%.

Example 6

The procedure of Example 1 was repeated, except that the spherical resin particles were changed to spherical acryl resin particles (TECHNO POLYMER XX-16FM, volume average particle diameter: 0.3 μm, product of SEKISUI PLASTICS CO., LTD.), to thereby produce intermediate transfer belt F.

From an electron microscopic cross-sectional image of the produced belt, the embedment rate of the particles in the resin layer was found to be 51%.

Example 7

The procedure of Example 3 was repeated, except that the press force of the press member as illustrated in FIG. 4 was changed to 50 mN/cm, so that the embedment rate of the particles was changed to 55%, to thereby produce intermediate transfer belt H.

Example 8

The procedure of Example 3 was repeated, except that the press force of the press member as illustrated in FIG. 4 was changed to 1,000 mN/cm, so that the embedment rate of the particles was changed to 90%, to thereby produce intermediate transfer belt I.

Comparative Example 1

The procedure of Example 3 was repeated, except that the press force of the press member as illustrated in FIG. 4 was changed to 20 mN/cm, so that the embedment rate of the particles was changed to 45%, to thereby produce intermediate transfer belt G.

Comparative Example 2

The procedure of Example 3 was repeated, except that the press force of the press member as illustrated in FIG. 4 was changed to 2,000 mN/cm, so that the embedment rate of the particles was changed to 100%, to thereby produce intermediate transfer belt J.

Comparative Example 3

The procedure of Example 1 was repeated, except that no particle layer was formed, to thereby produce intermediate transfer belt K.

Comparative Example 4

A base layer-coating liquid was prepared as follows, and was used to produce a base layer 81 of a seamless belt.

<Preparation of Base-Layer Coating Liquid>

First, carbon black (SPECIAL BLACK 4, product of Evonik Degussa) was dispersed in N-methyl-2-pyrrolidone with a bead mill. The resultant dispersion liquid was added to polyimide varnish mainly containing a polyimide resin precursor (U-VARNISH A, product of UBE INDUSTRIES, LTD.) so that the carbon black content was adjusted to 17% by mass of the solid content of polyamic acid, followed by thoroughly stirring and mixing, to thereby prepare a coating liquid.

[Production of Seamless Belt]

Next, a metal cylinder (outer diameter: 100 mm, length: 300 mm) was subjected to blast treatment so as to have a rough surface, and then used as a mold. While the resultant cylindrical mold was being rotated at 50 rpm, the above base layer-coating liquid was uniformly flow-cast onto the outer surface of the cylindrical mold using a dispenser. At the point when all of a predetermined amount of the coating liquid was flow-cast and then uniformly spread on the outer surface of the cylindrical mold, the rotation speed was increased to 100 rpm. The resultant cylindrical mold was placed in a hot air-circulating dryer, and gradually heated to 110° C., followed by heating for 60 minutes. Moreover, the cylindrical mold was further heated to 200° C., followed by heating for 20 minutes. Subsequently, the rotation was stopped, and then the cylindrical mold was gradually cooled and taken out from the dryer. Thereafter, the cylindrical mold was placed in a heating furnace (baking furnace) which could perform high-temperature treatment, and was heated (baked) stepwise to 320° C., followed by heating for 60 minutes.

After thorough cooling, a resin layer-coating liquid prepared as follows was used to form a resin layer 82 on the base layer 81.

<Preparation of Resin Layer-Coating Liquid>

[Preparation of Resin Layer-Coating Liquid]

First, the below-given materials were mixed together, and then thoroughly kneaded with a biaxial kneader, to thereby produce a masterbatch.

<Materials for Carbon Masterbatch A for Intermediate Layer>

Epoxy-silicone copolymer (ALBIFLEX 348, silicone content: 60% by mass, product of Nanoresins): 20 parts by mass Carbon black (VULCAN XC72, product of Cabot Co.): 100 parts by mass The carbon masterbatch A was mixed with the below-given materials, to thereby obtain a coating liquid.

<Materials for Resin Layer-Coating Liquid>

Carbon masterbatch A: 8 parts by mass

Epoxy-silicone copolymer (ALBIFLEX 348, silicone content: 60% by mass, product of Nanoresins): 40 parts by mass Methyltetrahydrophthalic anhydride (HN-2000, product of Hitachi Chemical Co., Ltd.): 8 parts by mass

[Formation of Resin Layer on Base Layer]

Similarly, the above resin layer-coating liquid was uniformly flow-cast on the above-formed polyimide base layer with a dispenser. The coating amount was set so that the final layer thickness was adjusted to 300 μm. At the point when all of a predetermined amount of the coating liquid was flow-cast and then uniformly spread on the outer surface of the cylindrical mold, the cylindrical mold was placed in a hot air-circulating dryer while being rotated. Then, the cylindrical mold was heated to 120° C. at a temperature increasing rate of 4° C./min, followed by heating for 30 min. Further, the cylindrical mold was heated to 250° C. at a temperature increasing rate of 4° C./min, followed by heating for 120 min. After the heating had been stopped, the cylindrical mold was gradually cooled to ambient temperature.

After thorough cooling, a surface layer-coating liquid prepared below was used to form a surface layer 83 on the resin layer 82.

<Preparation of Surface Layer-Coating Liquid>

The following materials were ultrasonically dispersed to prepare a surface layer-coating liquid.

Epoxy-silicone copolymer (ALBIFLEX 348, silicone content: 60% by mass, product of Nanoresins): 20 parts by mass Methyltetrahydrophthalic anhydride (HN-2000, product of Hitachi Chemical Co., Ltd.): 4 parts by mass Silicone resin particles (TOSPEARL 120, product of Momentive Performance Materials Inc.): 20 parts by mass Solvent (tetrahydrofuran): 100 parts by mass The resin layer 82 was sprayed with the above surface layer-coating liquid, followed by curing under heating at 250° C./h, to thereby produce intermediate transfer belt L having a surface layer 83 thereon.

FIG. 8 illustrates an electron microscopic cross-sectional image of the produced belt.

The surface of the belt was formed to have a concavo-convex shape of the particles, but a plurality of particles 84 were stacked in the thickness direction.

Comparative Example 5

The procedure of Example 2 was repeated, except that the spherical resin particles were changed to silicone resin amorphous particles (TOSPEARL 240, volume average particle diameter: 4.0 μm, product of Momentive Performance Materials Inc.), to thereby produce intermediate transfer belt M.

Comparative Example 6

The procedure of Example 2 was repeated, except that the spherical resin particles were changed to spherical silica particles (SEAHOSTAR KE-P250, volume average particle diameter: 2.5 μm, product of Nippon Shokubai Co., Ltd.), to thereby produce intermediate transfer belt N.

Next, each of intermediate transfer belts A to N of Examples and Comparative Examples was mounted to an image forming apparatus illustrated in FIG. 6, and was evaluated for the following properties. The results are shown in Table 1.

(I) Measurement of Transfer Rate

Transfer paper used was a Japanese paper having a concavo-convex pattern on its surface (SAZANAMI FC JAPANESE PAPER, product of Ricoh Company, Ltd.). Blue solid images were formed on the transfer paper. After and before transfer of the toner onto the paper, the amount of the toner on the intermediate transfer belt was measured. The obtained measurements were used to calculate a transfer rate.

Regarding the transfer rate, 90% or higher transfer rate is "pass," and 95% or higher transfer rate is more preferred.

Transfer rate(%)=(1−amount of toner on the belt after transfer (g)/amount of toner on the belt before transfer(g))×100

(II) Measurement of Transfer Rate after 10,000 Sheets Continuous Printing

A test chart was continuously printed on 10,000 sheets, and then printing was terminated. The transfer rate was measured with the above-described method (I).

(III) Image Evaluation after 10,000 Sheets Continuous Printing

A test chart was continuously printed on 10,000 sheets. Then, a halftone image of monotonic cyan was printed to observe abnormal image.

TABLE 1

| | | Initial | After 10,000 sheets printing | | |
|---|---|---|---|---|---|
| | Belt | Transfer rate (%) | Transfer rate (%) | Abnormal image | Other abnormities |
| Ex. 1 | A | 95.3 | 95.3 | | |
| Ex. 2 | B | 95.6 | 95.5 | | |
| Ex. 3 | C | 97.5 | 97.6 | | |
| Ex. 4 | D | 96.1 | 96.2 | | |
| Ex. 5 | E | 92.2 | 90.3 | Streaky image was partially observed | Streaky cleaning failure was partially observed |
| Ex. 6 | F | 90.3 | 90.1 | | |
| Comp. Ex. 1 | G | 98.5 | 75.6 | | |
| Ex. 7 | H | 96.5 | 95.6 | | |
| Ex. 8 | I | 95.1 | 94.8 | | |
| Comp. Ex. 2 | J | 75.3 | 75.5 | | |
| Comp. Ex. 3 | K | 65.3 | 50.2 | Lowered image density | Toner fixed on the belt was observed |
| Comp. Ex. 4 | L | 80.2 | 79.8 | Uneven image density | |
| Comp. Ex. 5 | M | 75.8 | 71.2 | | |
| Comp. Ex. 6 | N | 88.5 | 88.6 | Some black spots were observed | Pinhole defects were observed in the photoconductor surface |

As described above, the intermediate transfer belt of the present invention having the above-described configuration can realize a high transfer rate regardless of the type of the recording medium, can be consistently used for a long period of time, does not damage organic photoconductors, and can provide an image forming apparatus forming highly durable, high-quality images.

What is claimed is:

1. An image forming apparatus comprising:

an intermediate transfer belt; and a lubricant applying unit comprising a solid lubricant and a conducting brush configured to apply the solid lubricant onto a surface of the intermediate transfer belt, wherein the intermediate transfer belt comprises:

a resin layer, which is a surface layer of the intermediate transfer belt, wherein the resin layer has a concavo-convex pattern formed by spherical resin particles which are fine silicone resin particles or fine acryl resin particles independently embedded in the resin layer so that the embedment rate of the spherical resin particles in the thickness direction of the resin layer is higher than 50% but lower than 100%; and wherein for each spherical resin particle amongst the spherical resin particles forming the concavo-convex pattern on a surface of the resin layer, a diameter of the spherical resin particle is within a range of ±50% of an average particle diameter of the spherical resin particles.

2. The image forming apparatus according to claim 1, wherein the spherical resin particles are monodispersed particles having an average particle diameter of 0.5 μm to 5.0 μm.

3. The image forming apparatus according to claim 1, wherein the spherical resin particles are contained in the resin layer at a uniform state in the thickness direction of the resin layer.

4. The image forming apparatus according to claim 1, wherein the resin of the resin layer contains a thermosetting elastomer or rubber material.

5. The image forming apparatus according to claim 1, wherein for each spherical resin particle amongst said all of the spherical resin particles forming the concavo-convex pattern on the surface of the resin layer, the diameter of the spherical resin particle is within the range of ±50% of an average particle diameter of said all of the spherical resin particles.

6. The image forming apparatus according to claim 1, wherein the spherical resin particles are monodispersed particles having an average particle diameter greater than 3.0 μm but lower than 5.0 μm.

7. An image forming apparatus comprising:

a plurality of rollers;

an intermediate transfer belt stretched around the plurality of rollers; and a lubricant applying unit comprising a solid lubricant and a conducting brush configured to apply the solid lubricant onto a surface of the intermediate transfer belt, wherein the intermediate transfer belt comprises:

a resin layer, which is a surface layer of the intermediate transfer belt, wherein the resin layer has a concavo-convex pattern formed by spherical resin particles which are fine silicone resin particles or fine acryl resin particles independently embedded in the resin layer so that the embedment rate of the spherical resin particles in the thickness direction of the resin layer is higher than 50% but lower than 100%; and wherein for each spherical resin particle amongst the spherical resin particles forming the concavo-convex pattern on a surface of the resin layer, a diameter of the spherical resin particle is within a range of ±50% of an average particle diameter of the spherical resin particles.

8. The image forming apparatus according to claim 7, wherein the spherical resin particles are monodispersed particles having an average particle diameter of 0.5 μm to 5.0 μm.

9. The image forming apparatus according to claim 7, wherein the spherical resin particles are contained in the resin layer at a uniform state in the thickness direction of the resin layer.

10. The image forming apparatus according to claim 7, wherein the resin of the resin layer contains a thermosetting elastomer or rubber material.

* * * * *